US006532594B1

(12) United States Patent
Barnett

(10) Patent No.: US 6,532,594 B1
(45) Date of Patent: Mar. 18, 2003

(54) PROTECTIVE INSERT PAD FOR BALL GLOVE

(76) Inventor: Eddie C. Barnett, 321 16th Ave., Council Bluff, IA (US) 51503

( * ) Notice: Subject to any disclaimer, the term of this patent is extended or adjusted under 35 U.S.C. 154(b) by 0 days.

(21) Appl. No.: 10/152,252

(22) Filed: May 20, 2002

(51) Int. Cl.[7] ..... A41D 13/08
(52) U.S. Cl. ..... 2/20; 2/16
(58) Field of Search ..... 2/16, 20, 21, 18, 2/19, 159, 161.1, 161.3, 267; 28/879, 880; 602/21, 22, 30

(56) References Cited

U.S. PATENT DOCUMENTS 2,797,687 A * 7/1957 Crawford ..... 602/30
3,890,648 A 6/1975 Beal
D243,132 S 1/1977 Lowrey
D243,133 S 1/1977 Lowrey
4,461,043 A * 7/1984 Lomedico ..... 2/21
4,617,684 A 10/1986 Green et al.
4,977,621 A * 12/1990 Richard ..... 2/161.3
4,987,611 A 1/1991 Maye
5,173,963 A 12/1992 Greenberg
5,285,529 A 2/1994 Arena
5,689,828 A 11/1997 Mah
5,768,704 A 6/1998 Greenhalgh
6,119,267 A * 9/2000 Pozzi ..... 2/20
6,292,946 B1 9/2001 Angione

* cited by examiner

*Primary Examiner*—Gary L. Welch
(74) *Attorney, Agent, or Firm*—Joseph H. Beumer

(57) ABSTRACT

A protective insert for placement underneath a baseball or softball glove takes the form of a flat circular disk of a high density microcellular urethane padding material. The disk has an internal cutout pattern of two inverted v-shaped channels which enclose upper portions of a pair of triangular fingers and which define an outer rim and a spoke member between the triangular fingers. To place the disk in position for use, index and middle fingers of a player are threaded between the outer rim and tops of the triangular fingers, and the disk is pulled downward so as to locate the lower portion of the disk over the palm of the user's hand. The outer rim, spoke and triangular fingers hold the disk in position without the presence of external connections.

6 Claims, 2 Drawing Sheets

PROTECTIVE INSERT PAD FOR BALL GLOVE

FIELD OF THE INVENTION

This invention relates to sporting goods and more particularly to insert pads for baseball gloves and softball gloves.

BACKGROUND OF THE INVENTION

A need exists for providing more padding than is available in baseball and softball gloves as purchased, especially for younger players. Inadequate padding may result in infliction of pain or injury by impact with fast-moving balls. One approach to this problem has been to use removable inserts of padding material placed in position underneath the glove. Such inserts have generally comprised a body of cushioning material sized to cover vulnerable areas of the palm and fingers and separate components for securing the pad to the hand in the form of finger sleeves, bands or loops attachable to fingers or the wrist of the player. It is desired to provide a simplified but effective padding insert wherein not only the protective portion of the insert but also the means for securing the insert to the fingers of the player are included in an integral body of padding material fashioned to perform all necessary functions without the presence of other components.

SUMMARY OF THE INVENTION

The present invention is directed to a padding insert for placement on the hand of a player underneath a baseball or softball glove, the insert comprising a flat, generally circular disk of durable cushioning material having an internal cutout pattern in the form of a pair of rounded, inverted v-shaped channels extending through the disk at the upper half thereof. Each of the channels defines a generally triangular projection having a base located along a line extending across the diameter of the disk and a rounded upper end spaced apart from an outer rim between outer edges of the channels and the outer circumference of the disk. The outer rim extends around from the outer end of one of the channels to the outer end of the other. Integral with the outer rim, a spoke member extends from the outer rim inward between the two projections to the solid portion of the disks below the bases of the projections.

The disk may be installed on a player's hand by holding it in front of an outstretched palm and fingers with tips of the index and middle fingers directly underneath the tops of the two projections. The fingers are then threaded through tops of the channels, causing the rim to be bent backward and the projections to be bent slightly forward. Upon pulling the disk all the way down, the solid bottom portion of the disk is located over the most vulnerable part of the palm, and the two projections extend generally parallel in front of the two fingers so as to so to provide protection to lower joint areas. When in this position the outer rim and projections exert enough pressure on the fingers to restrain the disk from slipping. A conventional glove is then put on over the disk without interfering with the glove, but at the same time providing needed padding at the center of the "pocket" in the glove.

Material used for forming the disk may be selected to meet several requirements, in particular, a maximum damping effect and minimum recoil, consistent with strength, durability an sufficient flexibility to enable bending of the outer rim and spoke member in relation to the projections and solid portion of the disk, such relative movement being necessary for placement of the disk in position. Certain foamed elastomeric products in sheet form are preferred.

Padding inserts embodying the invention may be readily prepared by a simple stamping operation wherein a sheet of selected material is subjected to being cut around the circumference of the disk and at the desired channel locations.

It is therefore an object of this invention to provide a protective padding insert for baseball and softball gloves wherein the body of protective material includes as an integral portion thereof features necessary to secure the insert to fingers of the user.

Another object is to provide inserts which may be readily manufactured by stamping from sheet material.

Other objects and advantages of the invention will be apparent from the following description and the appended claims.

DESCRIPTION OF THE PREFERRED EMBODIMENT

Figure 1:
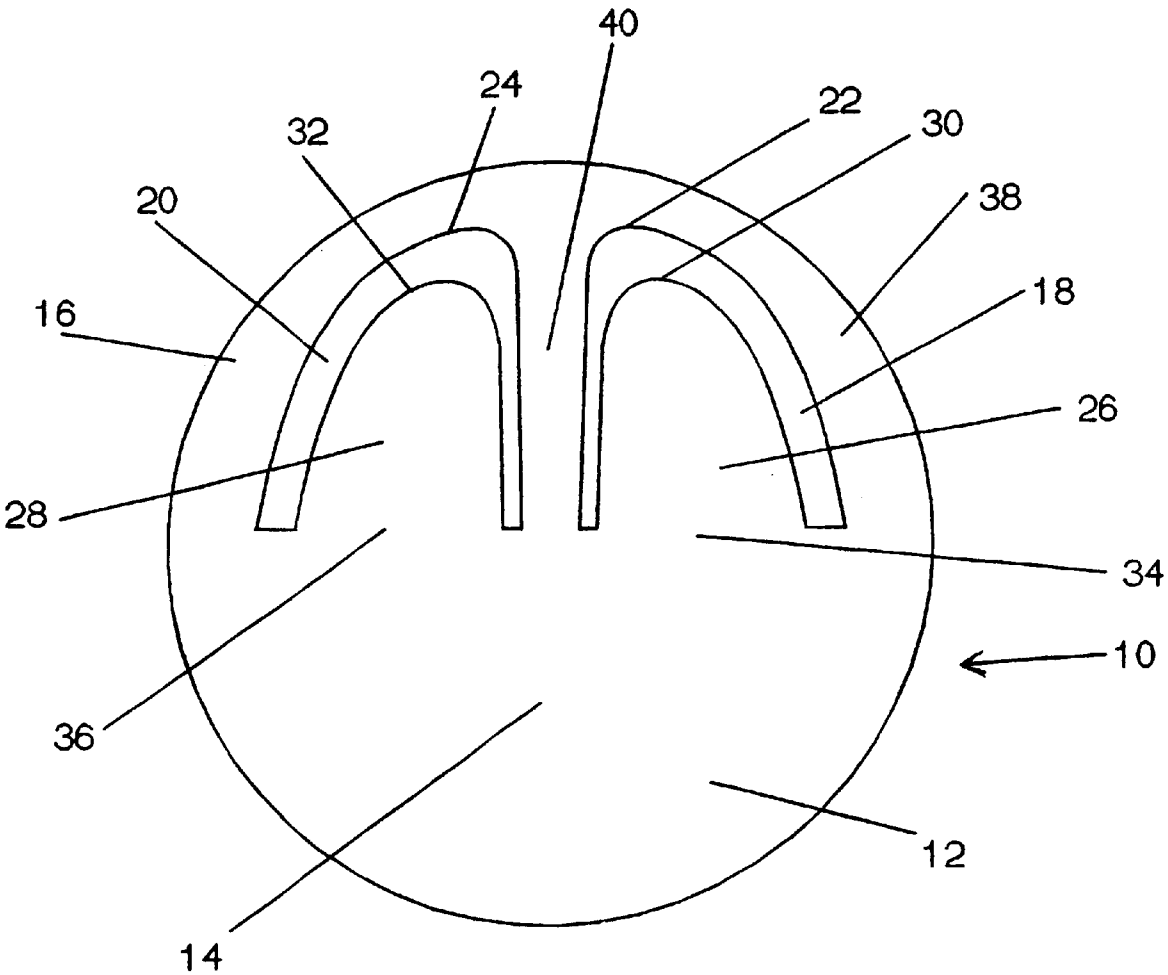
FIG. 1 is a front elevational view of an insert embodying the invention.

Referring to the drawings, there is shown an insert 10 in the form of a circular disk 12 cut from a thick sheet of padding material such as a foamed elastomeric composition, in particular a high density, microcellular urethane product to be described below. The disk may have a diameter selected for a specific size and age group of players, with a diameter from 2½ to 4 inches being suitable in most cases. A thickness of 3/16 to 5/8 inch may be used, and ¼ inch is preferred. The disk has a lower, solid portion 14 defined by a line extending across the disk horizontally and slightly above its center, and an upper portion 16 comprising the rest of the disk, the upper portion having a pair of inverted, generally v-shaped channels 18, 20 cut through the thickness of the disk. Top portions 22, 24 of the channels are rounded off to avoid the presence of sharp corners, which could weaken the remaining structure. Inside of the channels a pair of upwardly extending, generally triangular fingers 26, 28 are provided, the fingers having rounded tops 30, 32 and bases 34, 36 integral with lower portion 14. In addition to the fingers, upper portion 16 has an outer rim 38 made up of remaining portions between outer edges of the channels and the edge of the disk and a spoke member 40 between the channels and extending from the base of the channels to rim 38. The channels may have a minimum width of ⅛ inch, and the spoke and rim may each have a minimum width of ¼ inch for the embodiment shown.

Material for the disk is selected to provide a maximum capacity for shock absorption and damping, consistent with internal strength and resistance to tearing. A preferred material is a high density, microcellular urethane available from Rogers Corporation under the designation PORON 4701-5015250-04 UR. This formulation has a density of 15 pounds per cubic foot; a hardness, durometer, Shore O, of 18; and a tear strength of 6 pli, min. It is further characterized by its suitable flexibility and resistance to compression set.

Figure 2:
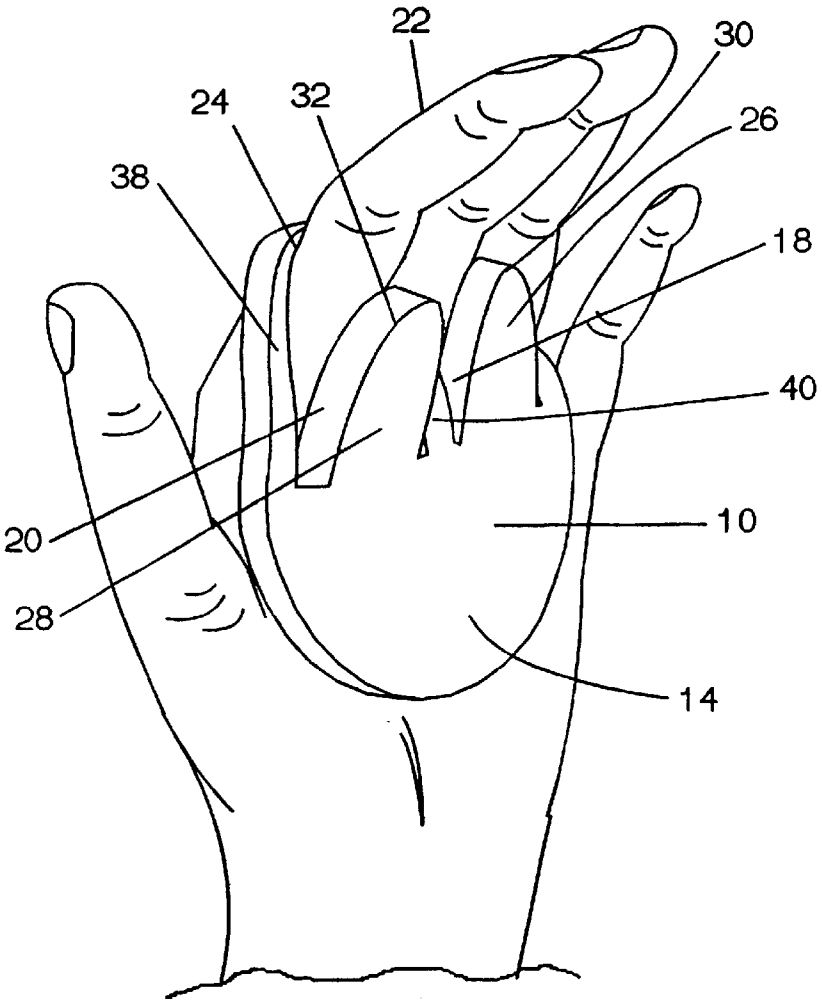
FIG. 2 is a front perspective view showing the insert installed on the hand of a user.

As shown in FIG. 2, the insert is easily installed on a user's hand by threading the index and middle fingers through upper portions 22, 24 of the channels from behind and underneath, thus bending fingers 26, 28 of the insert forward and outer rim 38 slightly backward. This brings lower portion 14 of the insert into a position over the palm of the hand and fingers 26, 28 in place in front of lower portions of the index and middle fingers. Movement of the insert is restrained by pressure exerted between the outer rim and bent-over fingers 26, 28. A conventional glove is then put on over the insert.

Inserts embodying the invention may be readily produced in a variety of sizes, enabling them to be offered in a manner which allows for custom fitting for individual players. The inserts may also be provided in various colors, which might be selected to coincide with team colors of customers. In addition, lower portion 14 of the insert provides ideal space for placement of logos, advertising material or the like.

While the invention is described above in terms of a specific embodiment, it is not to be construed as limited to that embodiment, but is limited only as indicated by the appended claims. It is to be understood that various changes and modifications may be made by one skilled in the art without departing from the spirit and scope of the invention. For example, while a circular disk is preferred, deviations from a strictly circular shape to one that is partially oval or oblong may be used, and such modifications are to be construed as falling within the term "generally circular".

What is claimed is:

1. A protective insert for placement on a hand of a player underneath a baseball or softball glove, said insert comprising:

a flat, generally circular disk cut from a thick sheet of flexible, durable cushioning material;

said disk having provided therein an internal cutout pattern including a pair of inverted v-shaped channels extending through the thickness of the disk and having their lower ends aligned along a diameter of the disk and their upper ends spaced apart from an outer edge of said disk so as to define an outer rim portion and said channels spaced apart from one another, defining a spoke member therebetween;

said channels further defining a pair of generally triangular fingers having their bases integral with a lower portion of said disk, wherein the fingers of said player are threaded through outer portions of said channels, causing said triangular fingers to be bent forward and said outer rim to be bent backward, securing said lower portion in place over the palm of a said hand.

2. The protective insert as defined in claim 1 wherein said disk is circular.

3. The insert as defined in claim 2 wherein said disk has a diameter of 2½ to 4 inches.

4. The insert as defined in claim 3 wherein said disk has a thickness of 3/16 to 5/8 inch.

5. The insert as defined in claim 1 wherein said material comprises a high density, microcellular urethane.

6. The insert as defined in claim 5 wherein said material has a density of 15 pounds per cubic foot , a Shore O hardness of 18, and a tear strength of 6 pli, min.

* * * * *